US011462156B2

(12) United States Patent
Yang et al.

(10) Patent No.: US 11,462,156 B2
(45) Date of Patent: Oct. 4, 2022

(54) DISPLAY DEVICE AND METHOD OF DRIVING DISPLAY DEVICE

(71) Applicant: Samsung Display Co., Ltd., Yongin-Si (KR)

(72) Inventors: Jin Wook Yang, Yongin-si (KR); Yu Chol Kim, Yongin-si (KR); Ji Hye Kim, Yongin-si (KR); Young Ha Sohn, Yongin-si (KR); Jae Hyeon Jeon, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/000,404

(22) Filed: Aug. 24, 2020

(65) Prior Publication Data

US 2021/0065620 A1 Mar. 4, 2021

(30) Foreign Application Priority Data

Aug. 29, 2019 (KR) ..... 10-2019-0106715

(51) Int. Cl.
*G09G 3/3208* (2016.01)

(52) U.S. Cl.
CPC ..... *G09G 3/3208* (2013.01); *G09G 2320/02* (2013.01); *G09G 2320/0686* (2013.01)

(58) Field of Classification Search
CPC .... G09G 3/3208; G09G 5/10; G09G 2320/02; G09G 2320/0233; G09G 2320/0686; G09G 2354/00; G09G 2340/04–0492; G09G 3/2074; G09G 3/32–3291; G09G 2360/14–148; G06F 3/0412; G06F 3/042; G06K 9/00006–00093; G06V 40/13–1394; G06V 40/1318; H01L 27/146; H01L 27/3234
See application file for complete search history.

(56) References Cited

U.S. PATENT DOCUMENTS

| | | | | |
|---|---|---|---|---|
| 10,268,884 | B2 | 4/2019 | Jones et al. | |
| 2018/0165533 | A1* | 6/2018 | Cho | G06V 40/10 |
| 2019/0130822 | A1 | 5/2019 | Jung et al. | |
| 2019/0310724 | A1* | 10/2019 | Yeke Yazdandoost | G02F 1/13338 |
| 2020/0213514 | A1* | 7/2020 | Kim | H04N 5/23238 |

FOREIGN PATENT DOCUMENTS

| | | | | |
|---|---|---|---|---|
| KR | 10-1346980 | B1 | 1/2014 | |
| KR | 10-2017-0113066 | A | 10/2017 | |
| KR | 20200079868 | A * | 7/2020 | H04N 5/23238 |

* cited by examiner

*Primary Examiner* — Amr A Awad
*Assistant Examiner* — Aaron Midkiff
(74) *Attorney, Agent, or Firm* — Innovation Counsel LLP

(57) ABSTRACT

The present disclosure relates to a display device and a method of driving the same. The display device includes a substrate, a display panel including a first display area including first pixels, a second display area including second pixels, and a third display area disposed between the first and second display areas and including third pixels, and a component disposed between the substrate and the display panel so as to overlap the second display area. Transmittance of the second display area is higher than transmittance of the first display area and transmittance of the third display area, and the third pixels are controlled such that a luminance gradually changes according to a distance from the second display area.

9 Claims, 20 Drawing Sheets

DISPLAY DEVICE AND METHOD OF DRIVING DISPLAY DEVICE

CROSS-REFERENCE TO RELATED APPLICATION

This application claims priority to Korean Patent Application No. 10-2019-0106715, filed on Aug. 29, 2019, and all the benefits accruing therefrom under 35 U.S.C. § 119, the content of which in its entirety is herein incorporated by reference.

BACKGROUND

1. Field

The present disclosure relates to a display device and a method of driving the display device. More particularly, the present disclosure relates to a display device in which a display area is maximized by disposing sensors on a rear surface of a display panel, and a driving method of the same.

2. Description of the Related Art

A flat panel display device has many advantages over a cathode ray tube. One of the advantages is that the flat panel display device may have less weight and volume than the cathode ray tube. Such a flat panel device includes a liquid crystal display (LCD) device, a field emission display (FED) device, a plasma display panel (PDP), and an organic light emitting display device, and the like. Among the flat panel displays, the organic light emitting display displays an image using an organic light emitting diode that generates light by recombination of an electron and a hole.

Recently, a camera, a proximity sensor, a fingerprint recognition sensor, an illuminance sensor, a near infrared sensor, and the like overlap a display area while the display area occupies most of a front surface of a mobile terminal or the like. A sensor area overlapping the display area reduces a density of a pixel in order to improve transmittance. At this time, a density change of the pixel between the sensor area and the display area may be visually recognized by a user as a discontinuity of the image. Therefore, a novel way to maximize a display area and minimize a sensor area to improve display quality is, therefore, needed.

SUMMARY

The present disclosure provides a display device in which a display area is maximized by disposing sensors on a rear surface of a display panel, and a driving method of the same.

The present disclosure provides a display device having improved transmittance of a sensor area in which a display area and sensors overlap each other, and a driving method of the same.

The present disclosure provides a display device and a method of driving the display device capable of reducing an image discontinuity at a boundary between the sensor area and the display area by controlling a luminance of the display area around the sensor area.

A display device according to embodiments of the present disclosure may comprise a substrate, a display panel including a first display area including a plurality of first pixels, a second display area including a plurality of second pixels, and a third display area disposed between the first and second display areas and including a plurality of third pixels, and a component disposed between the substrate and the display panel and overlapping the second display area. Transmittance of the second display area may be higher than transmittance of the first display area and transmittance of the third display area, and the plurality of third pixels may be controlled such that a luminance gradually changes according to a distance from the second display area.

According to an embodiment, each of the first pixels and third pixels may be disposed at a first density, and the second pixels may be disposed at a second density smaller than the first density.

According to an embodiment, the transmittance of the first display area may be the same as the transmittance of the third display area.

According to an embodiment, the plurality of first pixels may be controlled to emit light at a first luminance, the plurality of second pixels may be controlled to emit light at a second luminance, and the plurality of third pixels may be controlled such that the luminance gradually changes from the first luminance to the second luminance or from the second luminance to the first luminance according to the distance from the second display area.

According to an embodiment, the second display area may include second unit pixel areas each having at least one second pixel, and transmission areas alternately disposed with the second unit pixel areas, in which the second pixel is not disposed.

According to an embodiment, the third display area may include third unit pixel areas each having at least one third pixel.

According to an embodiment, the third unit pixel areas may include first group unit pixel areas and second group unit pixel areas that are alternately disposed and independently controlled in a luminance.

According to an embodiment, the first group unit pixel areas may be controlled to gradually decrease the luminance as the distance from the second display area increases, and the second group unit pixel areas may be controlled to gradually increase the luminance as the distance from the second display area increases.

According to an embodiment, the first group unit pixel areas closest to the second display area may be disposed to be in contact with the second unit pixel area.

According to an embodiment, a sum of the luminance of a pair of first group unit pixel area and second group unit pixel area adjacent to each other may be controlled to be an integer multiple of the first luminance.

According to an embodiment, the integer may be determined based on a ratio of the second luminance and the first luminance.

According to an embodiment, a width of the third display area may be variable based on a luminance range and a luminance change rate of the third unit pixel areas.

In order to achieve an object of the invention, a method of driving a display device comprising a substrate, a display panel including a first display area including a plurality of first pixels, a second display area including a plurality of second pixels, and a third display area disposed between the first and second display areas and including a plurality of third pixels, and a part disposed between the substrate and the display panel and overlapping the second display area may include receiving image data, correcting a luminance of the image data according to a display area corresponding to the image data, and displaying an image based on the corrected image data, wherein correcting the luminance may include correcting the luminance of the image data according to a distance from the second display area when arbitrary image data corresponds to the third display area.

According to an embodiment, the first pixels and third pixels may be disposed at a first density, and the second pixels may be disposed at a second density smaller than the first density.

According to an embodiment, correcting the luminance may include correcting the image data to a first luminance when the image data corresponds to the first display area, correcting the image data to a second luminance when the image data corresponds to the second display area, and correcting the image data to an arbitrary luminance between the first luminance and the second luminance according to the distance from the second display area when the image data corresponds to the third display area.

According to an embodiment, the second display area may include second unit pixel areas each having at least one second pixel, and transmission areas alternately disposed with the second unit pixel areas, in which the second pixel is not disposed.

According to an embodiment, the third display area may include third unit pixel areas each having at least one third pixel, and the third unit pixel areas may include first group unit pixel areas and second group unit pixel areas that are alternately disposed and independently controlled in a luminance.

According to an embodiment, the first group unit pixel areas may be controlled to gradually decrease the luminance according to the distance from the second display area, and the second group unit pixel areas may be controlled to gradually increase the luminance according to the distance from the second display area.

According to an embodiment, a sum of the luminance of a pair of the first group unit pixel area and the second group unit pixel area adjacent to each other may be controlled to be an integer multiple of the first luminance.

According to an embodiment, the integer may be determined based on a ratio of the second luminance and the first luminance.

The display device according to the embodiments of the present disclosure may reduce an image discontinuity at a boundary between a sensor area and the display area, and improve a user's visibility of the image.

BRIEF DESCRIPTION OF THE DRAWINGS

The above and other features of the present disclosure will become more apparent by describing in further detail exemplary embodiments thereof with reference to the accompanying drawings, in which.

DETAILED DESCRIPTION OF THE EMBODIMENT

Figure 1:
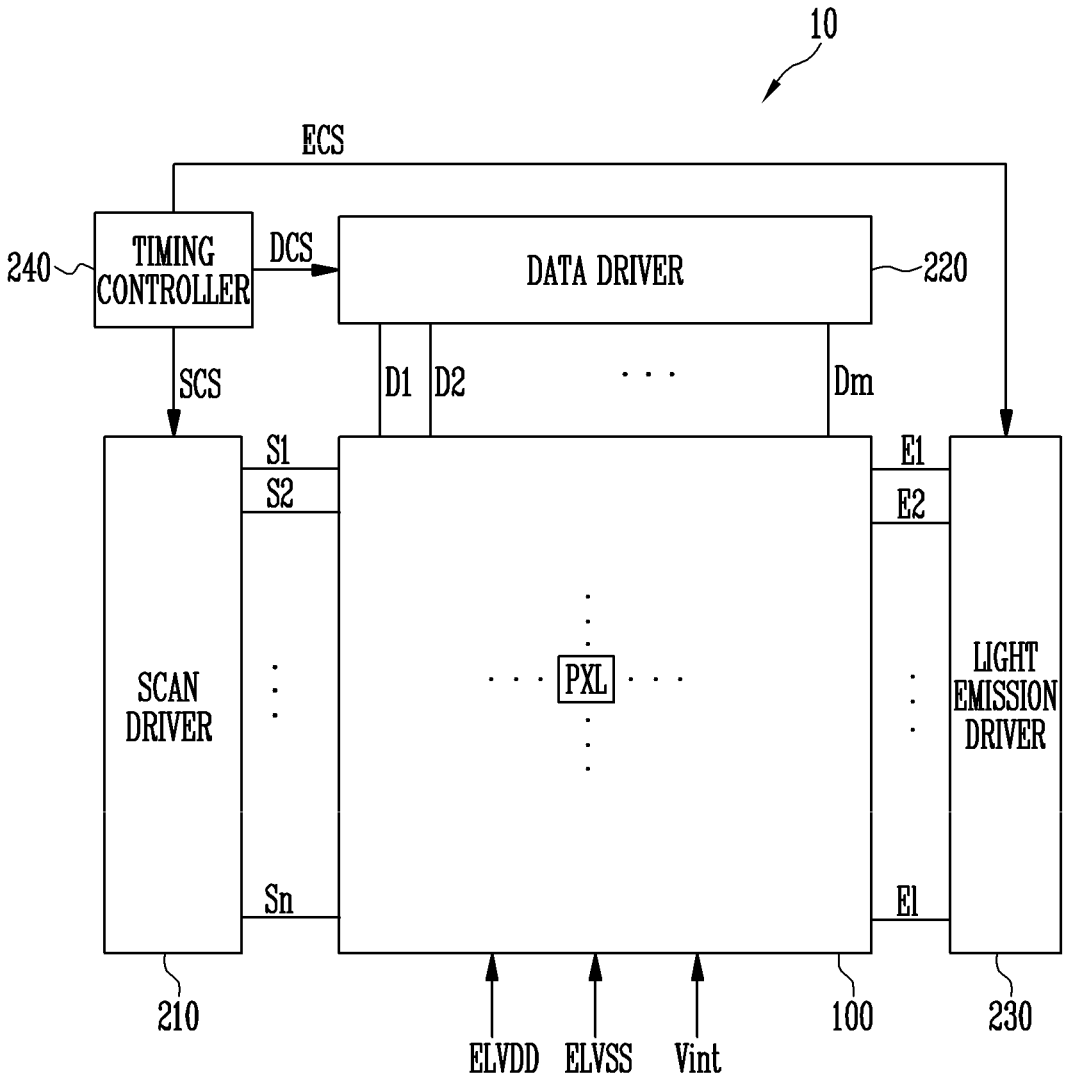
FIG. 1 is a block diagram illustrating a display device according to an embodiment.

The details of other embodiments are included in the detailed description and drawings.

The advantages and features of the present disclosure and a method achieving them will become apparent with reference to the embodiments described in detail below with reference to the accompanying drawings. However, the present disclosure is not limited to the embodiments described below, and may be embodied in various forms. In the following description, it is assumed that a case in which a part is connected to another part includes a case in which they are electrically connected to each other with another element interposed therebetween as well as a case in which they are directly connected to each other. In addition, in the drawings, parts which are not related to the invention are omitted for clarity of description, and similar parts are denoted by the same reference numerals throughout the specification.

FIG. 1 is a block diagram illustrating a display device according to an embodiment.

Referring to FIG. 1, the display device 10 may comprise a display panel 100 including a plurality of pixels PXL, a scan driver 210, a data driver 220, a light emission driver 230, and a timing controller 240.

The timing controller 240 may generate a scan driving control signal SCS, a data driving control signal DCS, and a light emission driving control signal ECS based on signals input from an external source. The scan driving control signal SCS, the data driving control signal DCS, and the light emission driving control signal ECS generated by the timing controller 240 may be supplied to the scan driver 210, the data driver 220, and the light emission driver 230, respectively.

The scan driving control signal SCS may include a scan start pulse and clock signals. The scan start pulse may control an output timing of a first scan signal, and the clock signals may control an output timing of the scan signals.

The data driving control signal DCS may include a source start pulse and clock signals. The source start pulse may control a sampling start time of data, and the clock signals may be used to control a sampling operation.

The light emission driving control signal ECS may include a light emission start pulse and clock signals. The light emission start pulse may control an output timing of a first light emission control signal, and the clock signals may control an output timing of light emission control signals.

The scan driver 210 may output a scan signal in correspondence with the scan driving control signal SCS. The scan driver 210 may supply the scan signal to scan lines S1 to Sn. The scan signal may be sequentially or simultaneously applied to the scan lines S1 to Sn.

The data driver 220 may supply data signals to data lines D1 to Dm in correspondence with the data driving control signal DCS. The data signals supplied to the data lines D1 to Dm may be applied to the pixels PXL of a pixel column selected by the scan signal. To this end, the data driver 220 may supply the data signals to the data lines D1 to Dm in synchronization with the scan signal.

The data driver 220 may apply data signals corresponding to image data provided from the outside to the data lines D1 to Dm during a display period in one frame.

The light emission driver 230 may supply light emission control signals to light emission control lines E1 to E1 in correspondence with the light emission driving control signal ECS. The light emission control signal may be sequentially or simultaneously applied to the light emission control lines E1 to E1. The pixels PXL supplied with the light emission control signals through the light emission control lines E1 to E1 may emit light at a luminance corresponding to the data signals applied from the data driver 220.

The display panel 100 may include a plurality of pixels PXL connected to the data lines D1 to Dm, the scan lines S1 to Sn, and the light emission control lines E1 to E1. A plurality of scan lines S1 to Sn may be connected to each pixel PXL in correspondence with a circuit structure of each pixel PXL.

The pixels PXL may receive first driving power ELVDD and second driving power ELVSS from an external source. The first driving power ELVDD may be set to a voltage higher than that of the second driving power ELVSS. In various embodiments, the pixels PXL may be further supplied with initialization power Vint.

Each of the pixels PXL may receive a data signal from a corresponding data line when a scan signal is supplied through a corresponding scan line during the display period. The pixel PXL receiving the data signal may control an amount of a current flowing from the first driving power ELVDD to the second driving power ELVSS in correspondence with the data signal through a light emitting element (not shown). When a light emission control signal is applied from a corresponding light emission control line, the light emitting element may generate light of a predetermined luminance in correspondence with the amount of the current.

Figure 2:
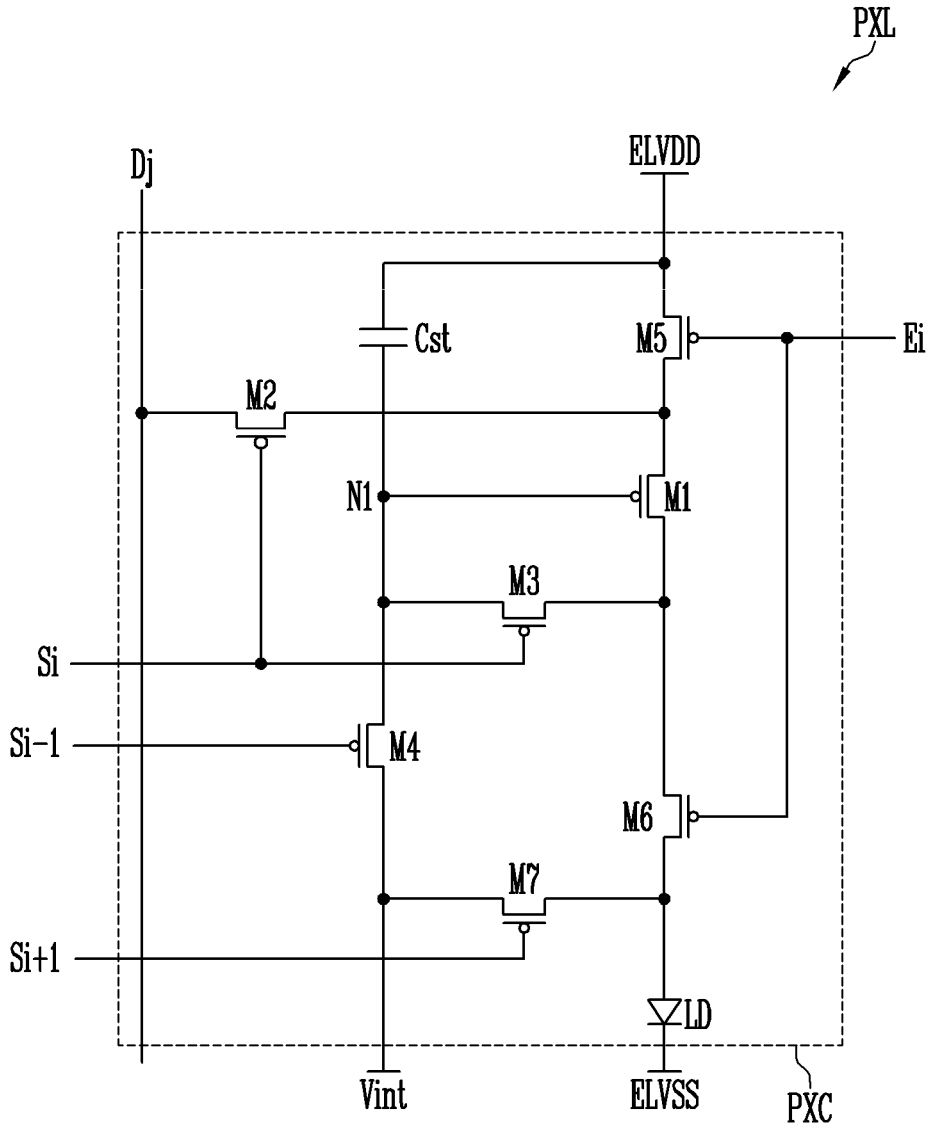
FIG. 2 is a circuit diagram illustrating a pixel according to an embodiment.

FIG. 2 is a circuit diagram illustrating the pixel PXL according to an embodiment. In FIG. 2, for convenience of description, an active type pixel connected to an i-th (i is a natural number) scan line Si that is disposed in an i-th horizontal pixel column and a j-th (j is a natural number) data line Dj that is disposed in a j-th vertical pixel column and including seven transistors is shown. However, a structure of the pixel PXL is not limited to a structure shown in FIG. 2.

Referring to FIG. 2, the pixel PXL according to an embodiment may include a pixel circuit PXC including first to seventh transistors M1 to M7, a storage capacitor Cst, and a light emitting element LD.

A first electrode of the first transistor M1 (driving transistor) may be connected to first power ELVDD through the fifth transistor M5 and a second electrode of the first transistor M1 may be connected to an anode electrode the light emitting element LD through the sixth transistor M6. In addition, a gate electrode of the first transistor M1 may be connected to a first node N1. The first transistor M1 may control an amount of a current flowing from the first power ELVDD to second power ELVSS through the light emitting element LD corresponding to a voltage of the first node N1.

The second transistor M2 (switching transistor) may be connected between the j-th data line Dj and the first electrode of the first transistor M1. In addition, a gate electrode of the second transistor M2 may be connected to the i-th scan line Si. The second transistor M2 may be turned on when a scan signal is supplied to the i-th scan line Si to electrically connect the j-th data line Dj and the first electrode of the first transistor M1 with each other.

The third transistor M3 (compensating transistor) may be connected between the second electrode of the first transistor M1 and the first node N1. In addition, a gate electrode of the third transistor M3 may be connected to the i-th scan line Si. The third transistor M3 may be turned on when a scan signal of a gate-on voltage is supplied to the i-th scan line Si to electrically connect the second electrode of the first transistor M1 and the first node N1 with each other. Therefore, when the third transistor M3 is turned on, the first transistor M1 may be connected in a diode form.

The fourth transistor M4 (initialization transistor) may be connected between the first node N1 and initialization power Vint. In addition, a gate electrode of the fourth transistor M4 may be connected to an (i−1)-th scan line Si−1. The fourth transistor M4 may be turned on when a scan signal is supplied to the (i−1)-th scan line Si−1 to supply a voltage of the initialization power Vint to the first node N1.

FIG. 2 illustrates an embodiment in which the (i−1)-th scan line Si−1 is used as an initialization control line for initializing a gate node of the first transistor M1, that is, the first node N1. However, the present disclosure is not limited. For example, in another embodiment, another control line such as an (i−2)-th scan line Si−2 may be used as the initialization control line for initializing the gate node of the first transistor M1.

The fifth transistor M5 (emission control transistor) may be connected between the first power ELVDD and the first transistor M1. In addition, a gate electrode of the fifth transistor M5 may be connected to an i-th light emitting control line Ei. The fifth transistor M5 may be turned off when a light emitting control signal of a gate-off voltage is supplied to the i-th light emitting control line Ei, and may be turned on in other cases.

The sixth transistor M6 (emission control transistor) may be connected between the first transistor M1 and the light emitting element LD. In addition, a gate electrode of the sixth transistor M6 may be connected to the i-th light emitting control line Ei. The sixth transistor M6 may be turned off the light emitting control signal of the gate-off voltage is supplied to the i-th light emitting control line Ei, and may be turned on in other cases.

The seventh transistor M7 (initialization transistor) may be connected between the initialization power Vint and a first electrode of the light emitting element LD, for example, an anode electrode. In addition, a gate electrode of the seventh transistor M7 may be connected to an (i+1)-th scan line Si+1. The seventh transistor may be turned on when a scan signal of a gate-on voltage (for example, a low level voltage) is supplied to the (i+1)-th scan line Si+1 to supply the voltage of the initialization power Vint to the anode electrode of the light emitting element LD. Here, the voltage of the initialization power Vint may be set to a voltage lower than the data signal. That is, the voltage of the initialization power Vint may be set to be equal to or less than a lowest voltage of the data signal.

FIG. 2 shows a case in which an anode initialization control line to which the gate electrode of the seventh transistor M7 is connected is the (i+1)-th scan line Si+1. However, the present disclosure is not limited. For example, in another embodiment, the gate electrode of the seventh transistor M7 may be connected to the i-th scan line Si. In this case, the voltage of the initialization power Vint may be supplied to the anode electrode of the light emitting element LD through the seventh transistor M7 when the scan signal of the gate-on voltage is supplied to the i-th scan line Si.

The storage capacitor Cst may be connected between the first power ELVDD and the first node N1. The storage capacitor Cst may store a voltage corresponding to the data signal and a threshold voltage of the first transistor M1.

The anode electrode of the light emitting element LD may be connected to the first transistor M1 through the sixth transistor M6 and a cathode electrode may be connected to the second power ELVSS. The light emitting element LD generates light of a predetermined luminance corresponding to the amount of the current supplied from the first transistor M1. A voltage value of the first power ELVDD may be set to be higher than a voltage value of the second power ELVSS so that the current may flow to the light emitting element LD.

The light emitting element LD may be, for example, an organic light emitting diode. The light emitting element LD may emit light of one of red, green, and blue.

On the other hand, the structure of the pixel PXL is not limited to the embodiment shown in FIG. 2. For example, the currently known pixel circuits of various structures may be applied to the pixel PXL.

Figure 3A:
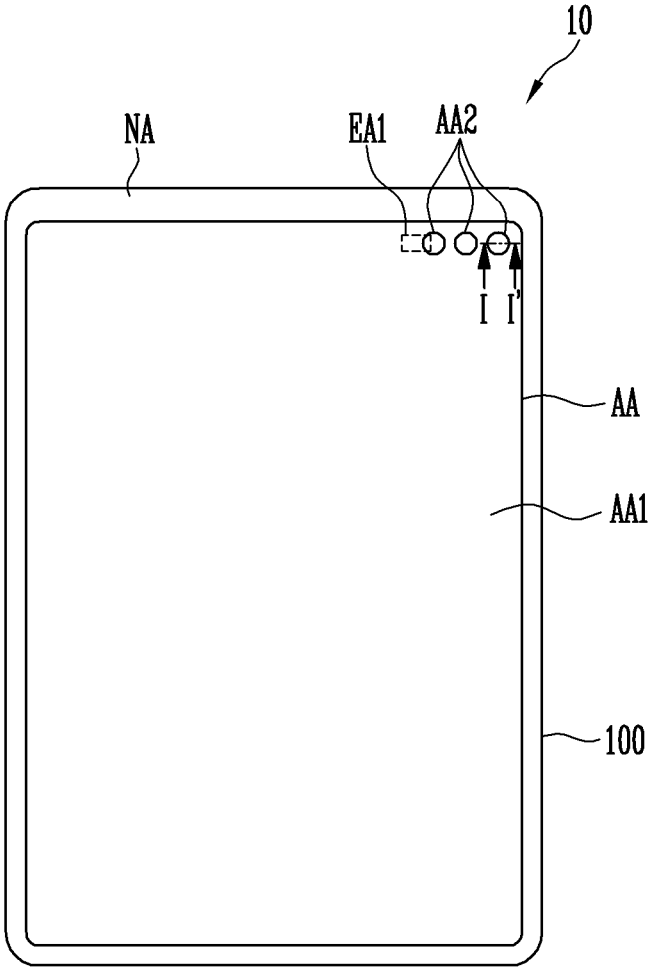
FIGS. 3A, 3B, and 3C are top plan views of the display device according to an embodiment.
Figure 3B:
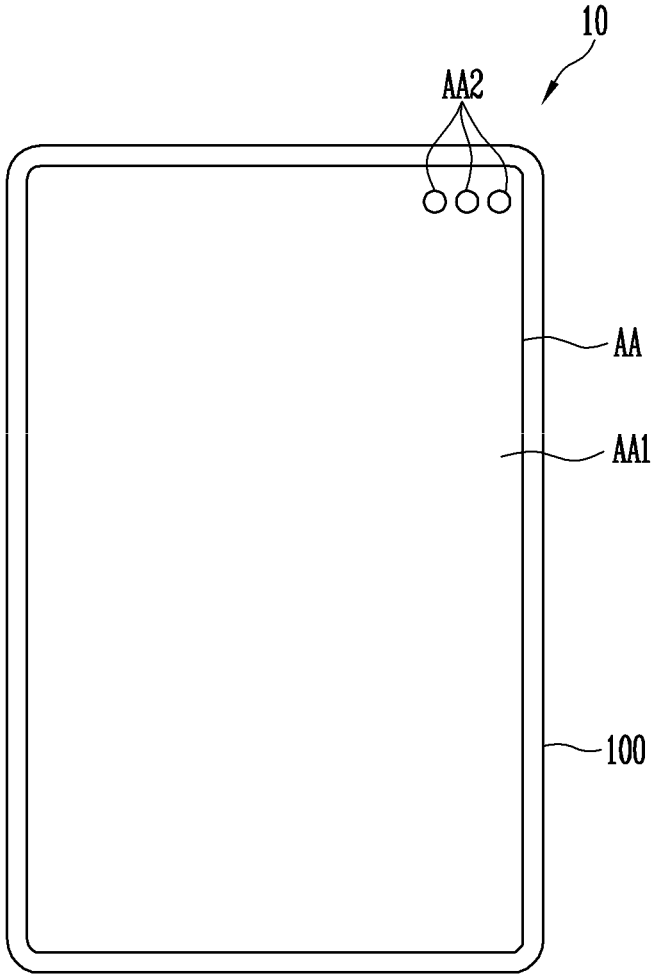
Figure 3C:
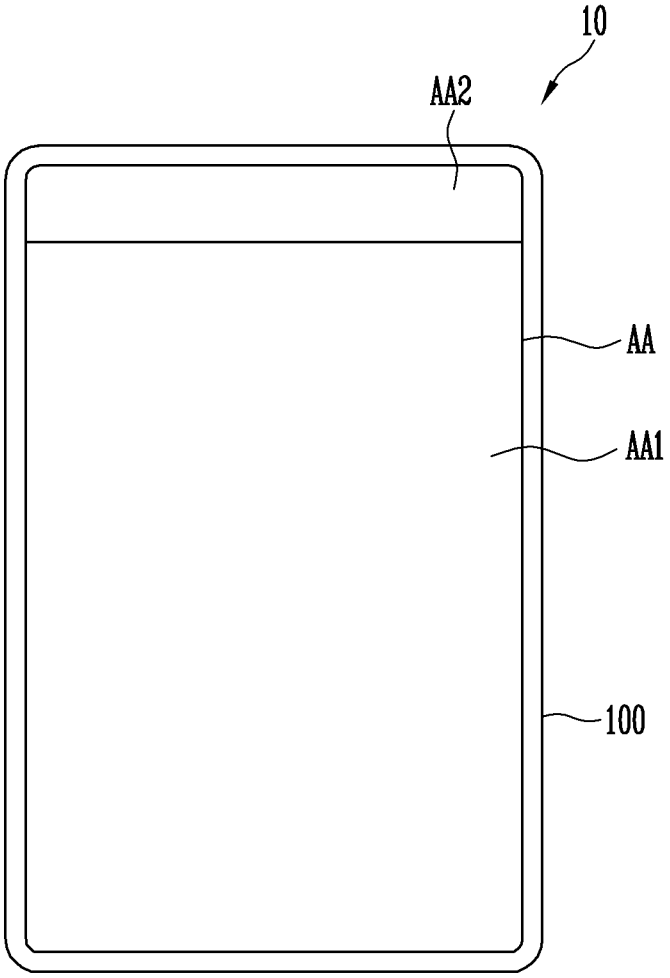

FIGS. 3A, 3B, and 3C are top plan views of the display device according to the present disclosure. In particular, FIGS. 3A, 3B, and 3C show a front surface of the display device 10.

The entire or at least some portions of the display device 10 may be flexible. For example, the display device 10 may have flexibility in the entire area, or may have flexibility in an area corresponding to the flexibility area.

Referring to FIG. 3A, the display panel 100 may be disposed on a front surface of the display device 10. The display panel 100 may include a display area AA and a non-display area NA surrounding the display area AA.

The display area AA is an area in which a plurality of pixels (or may be referred to as sub pixels, refer to FIG. 2) is disposed and may be referred to as an active area. In various embodiments, the display area AA may be disposed in a large screen to occupy most of the front surface of the display device 10.

The non-display area NA is an area disposed around the display area AA and may be provided at a front surface edge of the display device 10 as shown in FIG. 3A. The non-display area NA may be referred to as a non-active area, a bezel area, or a black matrix (BM) area. The non-display area NA may comprehensively refer to a remaining area except for the display area AA on the display panel 100.

The non-display area NA may include driving elements, lines, and various dummy areas for applying a driving signal to the display area AA. For example, in the non-display area NA, the scan driver 210, the data driver 220, the light emission driver 230, the timing controller 240, and various lines connected to the pixels PXL, which are shown in FIG. 1, may be disposed to drive the pixels PXL in the display area AA.

In an embodiment, the display area AA may be disposed on the entire front surface of the display device 10 as shown in FIG. 3B. Such a display device 10 may be referred to as a full front display. As the display area AA is disposed on the entire front surface of the display device 10, the non-display area NA may not be disposed or may be disposed in a very small area on the front surface. In such an embodiment, the display area AA may be in contact with a side edge of the display device 10 or may be disposed at a distance within or less than about 1 mm from the side edge.

FIGS. 3A and 3B show an embodiment in which the display area AA is disposed only on the front surface of the display device 10, but the present disclosure is not limited. That is, in various embodiments, the display area AA may be disposed on at least one area of the side edge of the display device 10 or at least one area of a rear surface. At least a portion of the display areas AA disposed on a plurality of surfaces of the display device 10 may be connected to or separated from each other.

In various embodiments of the present disclosure, the display device 10 may include components (not shown) that overlap the display area AA. The components may be disposed under the pixels PXL and/or the lines disposed in the display area AA, and may be concealed with respect to the front surface. When the parts are disposed under the pixels PXL and/or the lines disposed in the display area AA and overlap the display area AA as described above, an external appearance of the display device 10, in particular, a wider display area AA may be archived.

An area that does not overlap the components may be defined as a first display area AA1 and an area that overlaps the parts may be defined as a second display area AA2 (or a sensor area). However, in various embodiments, the second display area AA2 may be set to have an area wider than the area overlapping the parts. For example, the second display area AA2 may be widely formed at one end of the display device 10 as shown in FIG. 3C. In such an embodiment, a width of the first display area AA1 from an upper end edge of the display device 10 may be ranged from about 5 to about 8 mm.

The second display area AA2 is positioned inside the display area AA and may be surrounded by the first display area AA1. In FIGS. 3A and 3B, the second display area AA2 has a substantially circular shape, but the present disclosure is not limited. That is, the second display area AA2 may have various polygonal shapes including a rectangular shape (as shown in FIG. 3C) or an elliptical shape.

In addition, in FIGS. 3A, 3B, and 3C, at least one second display area AA2 is disposed only at an upper end of the front surface of the display device 10, but the present disclosure is not limited. That is, in various embodiments, one or more second display areas AA2 may be provided, and may be disposed adjacent to or distributed in the display area AA. For example, in an embodiment in which the display area AA is formed on the side edge and/or the rear side of the display device 10, a portion of the second display areas AA2 may be disposed in the display area AA of the side edge and/or in the display area AA of the rear surface.

The components disposed to overlap the second display area AA2 may be optical components. That is, the components may be parts that receive light or emit light. The components may include, for example, a fingerprint sensor, an image sensor, a camera, a strobe, a light sensor, an illuminance sensor, a proximity sensor, an RGB sensor, an infrared sensor, an indicator, a solar panel, and the like. However, the components are not limited to the optical components, and may include various components such as an ultrasonic sensor, a microphone, an environment sensor (for example, a barometer, a hygrometer, a thermometer, a radiation sensing sensor, a heat sensing sensor, and the like), a chemical sensor (a gas sensing sensor, a dust sensing sensor, an odor sensing sensor).

In an embodiment, as shown in FIGS. 3A and 3B, one second display area AA2 may overlap one component. For example, one of the second display areas AA2 may overlap the camera, the other may overlap the proximity sensor, and the other may overlap the illumination sensor.

However, in another embodiment, as shown in FIG. 3C, one second display area AA2 may overlap a plurality of sensors. For example, one of the second display areas AA2 may overlap the camera and the proximity sensor disposed side by side, and the other may overlap the illumination sensor.

The second display area AA2 may transmit a signal (for example, light) input to the components. In order to improve transmittance of the signal, transmittance of the second display area AA2 may be higher than that of the first display area AA1. Here, each of the transmittance of the second display area AA2 and the transmittance of the first display area AA1 may be a degree to which light is transmitted per unit area (a preset area, or the same area). For example, the transmittance may be a ratio of light transmitted through the display panel 100 to light incident on the unit area of the display panel 100. Therefore, the second display area AA2 having a relatively high transmittance may transmit a signal (and/or light) better than the first display area AA1.

For example, in the second display area AA2, the pixels PXL may be disposed at a density lower than that of the first display area AA1. A gap of the pixels PXL disposed at the lower density may form a physical and/or optical opening, thereby allowing the signal to be transmitted better. The disposition of the pixels PXL in the first display area AA1 and the second display area AA2 will be described below in more detail with reference to the drawings.

Figure 4:
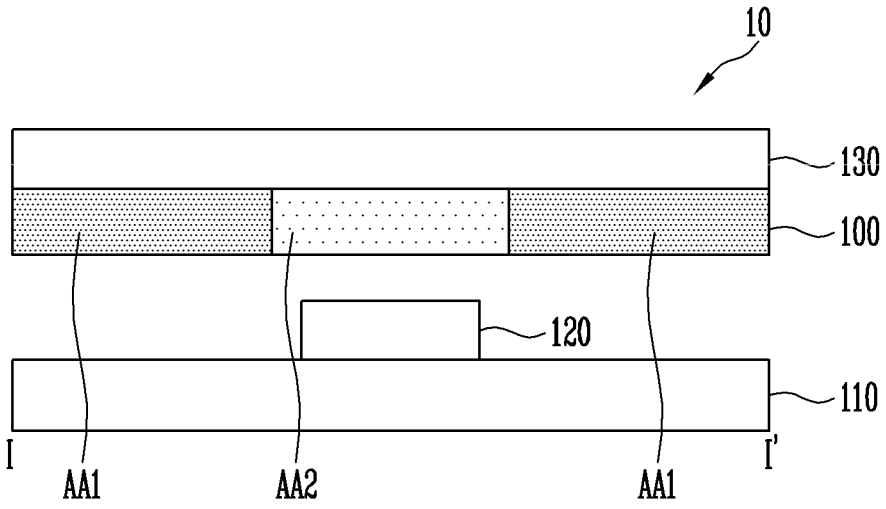
FIG. 4 is a schematic cross-sectional view taken along a line I-I' of FIG. 3A.

FIG. 4 is a schematic cross-sectional view taken along a line I-I' of FIG. 3A.

Referring to FIG. 4, the display device 10 may include a substrate 110, at least one sensor 120, a display panel 100, and a window 130. The substrate 110, the sensor 120, the display panel 100, and the window 130 may form a structure stacked in a vertical direction.

The substrate 110 may support the display panel 100 and the sensor 120. In an embodiment, the substrate 110 may be a bracket, a case, or the like, and may include a plastic or metal material. The substrate 110 may form an appearance of the rear surface of the display device 10 and may protect electrical components inside an electronic device from external stress.

The sensor 120 may be disposed on the substrate 110 in a surface mount device (SMD) manner. The sensor 120 may be disposed between the substrate 110 and the display panel 100. The sensor 120 may face at least one area of the display panel 100, for example, the second display area AA2.

Meanwhile, in FIG. 4, an example in which an arbitrary sensor 120 is disposed on the substrate 110 is shown, but the sensor 120 may be replaced with various components as described with reference to FIGS. 3A, 3B, and 3C.

The display panel 100 may be a flat panel display panel or a flexible display panel. For example, the display panel 100 may include a rigid base layer formed of glass, plastic, or the like, or a flexibility base layer such as a plastic film. The display panel 100 may display an image using pixels disposed on the base layer. As described with reference to FIG. 2, the pixels may include a pixel circuit formed in a circuit element layer and a light emitting element formed in a light emitting element layer. The light emitting element may be, for example, an organic light emitting diode. However, the light emitting element is not limited to the organic light emitting diode. For example, the light emitting element may be an inorganic light emitting element including an inorganic light emitting material or a light emitting element (quantum dot display element) that emits light by changing a wavelength of light emitted using a quantum dot. The display panel may display the image using the pixel circuit and the light emitting element.

The display panel 100 may include the first display area AA1 and the second display area AA2 facing the sensor 120 described with reference to FIGS. 3A, 3B, and 3C. The pixels may be disposed in the first display area AA1 and the second display area AA2.

The transmittances per unit area of the first display area AA1 and the second display area AA2 may be different from each other. For example, the transmittance per unit area of the second display area AA2 may be higher than the transmittance per unit area of the first display area AA1.

In an embodiment, the pixels may be disposed in different densities in the first display area AA1 and the second display area AA2. For example, the pixels may be disposed at a first density in the first display area AA1 and the pixels may be disposed at a second density in the second display area AA2. The second density may be set to be smaller than the first density. At this time, a material and a layout of each of the pixels in the first display area AA1 may be the same as a material and a layout of each of the pixels in the second display area AA2.

Here, the density (or pixel density) may be defined as a ratio (%) of the area where the pixels are disposed to the entire area of a corresponding display area. The area where the pixels are disposed may be a sum of the areas of each of the pixels. The area of the pixel may refer to the area of an area including the pixel circuit and the light emitting element.

In another embodiment, the area of the pixel may refer to the area of a light emission surface of the light emitting element. For example, when the pixel includes an organic light emitting diode, the area of the pixel may be the area of an anode electrode exposed between a pixel defining films, or the area of a light emission layer.

Alternatively, the density may be defined as the total number of pixels per unit area (pixel per inch (PPI)) of a corresponding display area.

In the following embodiments, the density is defined as the ratio of the area where the pixels are disposed to the entire area of the display area, the area of the pixel is the area of the area including the pixel circuit and the light emitting element, and the technical features of the invention will be described.

An area in which pixels are disposed relative to the entire area in the second display area AA2 may be smaller than in the first display area AA1. As the pixels are disposed at a relatively low density in the second display area AA2, the transmittance of the second display area AA2 may be higher than that of the first display area AA1.

As the density of the pixels in the second display area AA2 is smaller than in the first display area AA1, an image displayed in the second display area AA2 may be visually recognized darker (that is, at a lower luminance) relatively to an image displayed in the first display area AA1. In order to solve such a problem, the pixels disposed in the second display area AA2 may be controlled to emit light at a higher luminance with respect to the same image data.

Meanwhile, in another embodiment, at least one of the material and the layout of the pixels in the first display area AA1 may be different from at least one of the material and the layout of the pixels in the second display area AA2. However, in this case, the density of the pixels in the first display area AA1 and the density of the pixels in the second display area AA2 may be the same.

For example, the material of the pixels in the first display area AA1 may be different from the material of the pixels in the second display area AA2. For example, anode electrodes of the pixels in the first display area AA1 may include a reflective metal, and anode electrodes of the pixels in the second display area AA2 may include a transmissive metal. For example, the anode electrodes of the pixels in the first display area AA1 and the second display area AA2 may include one of a reflective metal and a transmissive metal, and a ratio of the anode electrodes having the transmissive metal in the second display area AA2 may be higher than a ratio of the anode electrodes having the transmissive metal in the first display area AA1. A light transmittance of the transmissive metal may be higher than a light transmittance of the reflective metal.

For example, specific wires of the pixels in the first display area AA1 may include a reflective metal, and corresponding specific wires of the pixels in the second display area AA2 may include a transmissive metal. For example, the specific wires of the pixels in the first display area AA1 and the second display area AA2 may include one of a reflective metal and a transmissive metal, and a ratio of the specific wires having the transmissive metal in the second display area AA2 may be higher than a ratio of the specific wires having the transmissive metal in the first display area AA1.

For example, a layout of the pixels in the first display area AA1 may be different from a layout of the pixels in the second display area AA2. For example, the area of corresponding specific wires of the pixels in the second display area AA2 may be smaller than the area of the specific wires of the pixels in the first display area AA1. Therefore, as a distance between the wires in the second display area AA2 increases, the transmittance of the second display area AA2 may be improved.

At least one of the density, the material, and the layout of the pixels of the second display area AA2 may be configured to be different from that of the pixels of the first display area AA1 such that the pixels of the second display area AA2 have a transmittance higher than that of the pixels of the first display area AA1.

Figure 5:
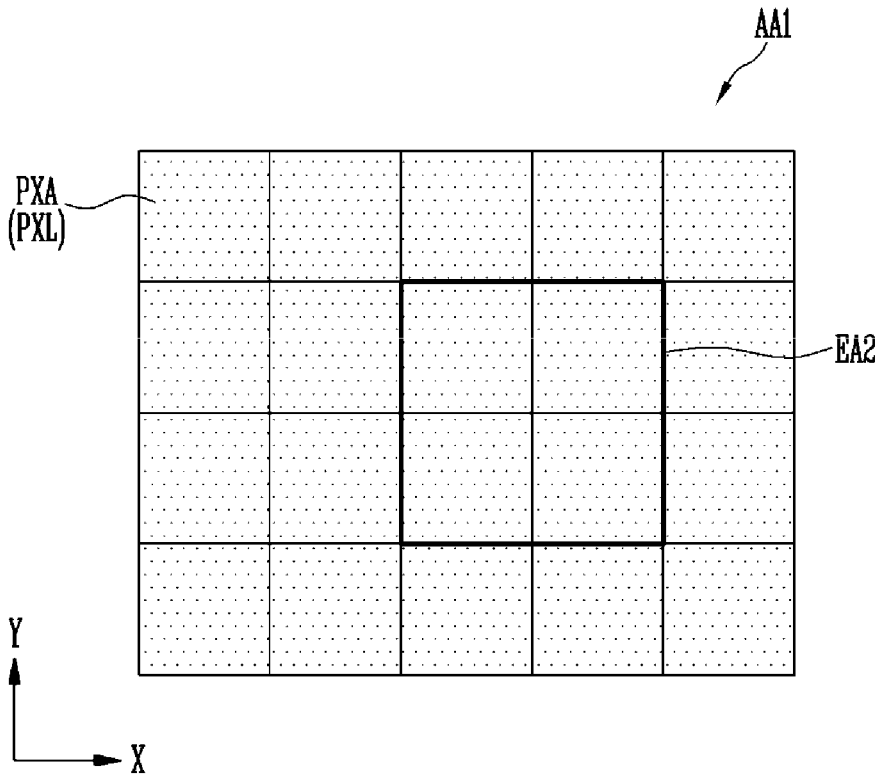
FIG. 5 is a top plan view schematically illustrating a first display area according to an embodiment.

As depicted in FIG. 5, the window 130 may be disposed at the uppermost portion of the display device 10. The window 130 may be a glass material or a synthetic resin material. The window 130 may include a transparent material. The window 130 may be provided to protect components disposed below.

Figure 6:
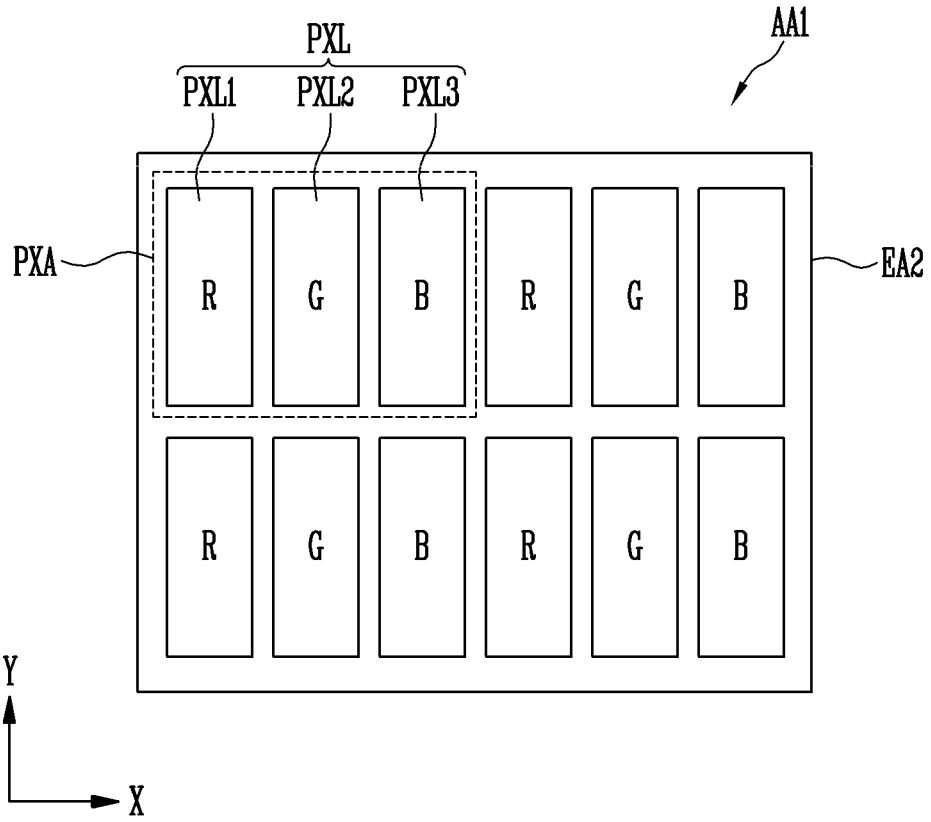
FIG. 6 is an enlarged view illustrating an EA2 region of FIG. 5 according to an embodiment.
Figure 7:
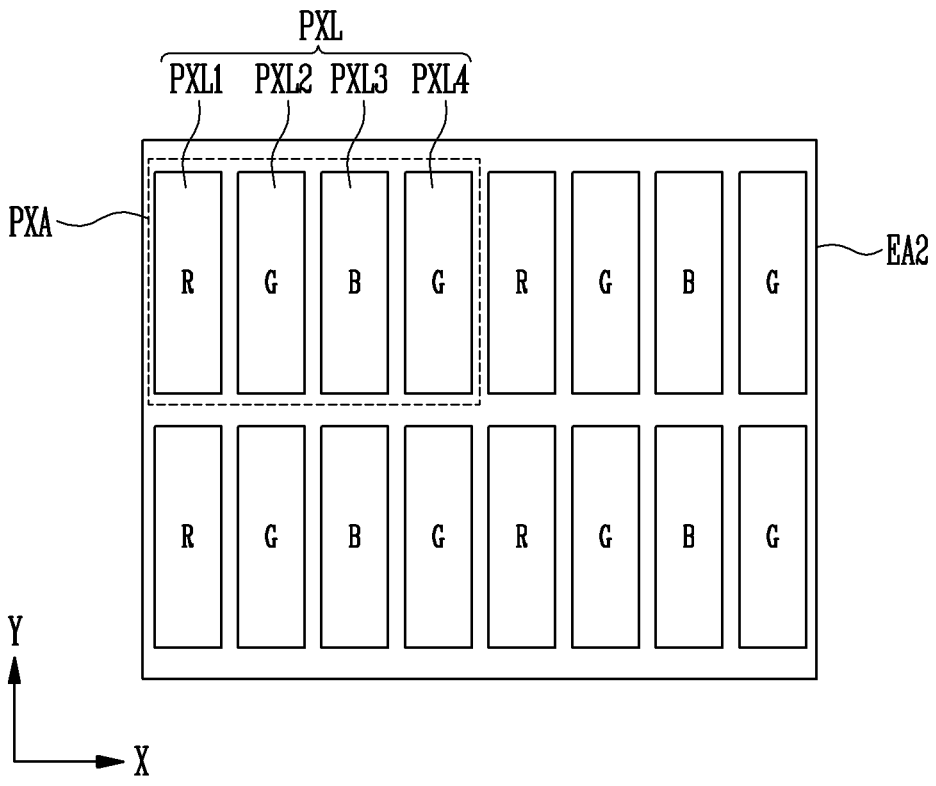
FIG. 7 is an enlarged view illustrating the EA2 region of FIG. 5 according to another embodiment.

FIG. 5 is a top plan view schematically illustrating the first display area according to an embodiment. FIG. 6 is an enlarged view illustrating an EA2 region of FIG. 5 according to an embodiment. FIG. 7 is an enlarged view illustrating the EA2 region of FIG. 5 according to another embodiment.

Referring to FIG. 5, the first display area AA1 may include unit pixel areas PXA arranged in a matrix form. The unit pixel areas PXA may be arranged in a predetermined number along a first direction X and a second direction Y according to a resolution of the display device 10. The first direction X and the second direction Y may be substantially perpendicular.

The unit pixel area PXA may include pixels PXL (or sub pixels) that emit light of the same or different colors as shown in FIGS. 6 and 7. For example, the pixels PXL may emit light of red R, green G, and blue B. However, the present disclosure is not limited. That is, the pixels PXL included in the unit pixel area PXA may emit light of various colors when the pixels PXL may realize white light by any combination of the above colors.

As depicted in FIG. 6, in an embodiment, the unit pixel area PXA may include first, second, and third pixels PXL1, PXL2, and PXL3 arranged in the first direction X. The first, second, and third pixels PXL1, PXL2, and PXL3 may be arranged in a stripe pattern. For example, the first pixel PXL1 may emit light of red R, the second pixel PXL2 may emit light of green G, and the third pixel PXL3 may emit light of blue B.

In an embodiment, the unit pixel area PXA may include first to fourth pixels PXL1 to PXL4 arranged in the first direction X as shown in FIG. 7. The first to fourth pixels PXL1 to PXL4 may be arranged in a pentile pattern. For example, the first pixel PXL1 may emit light of red R, the second pixel PXL2 may emit light of green G, the third pixel PXL3 may emit light of blue B, and the fourth pixel PXL4 may emit light of green G.

Meanwhile, although the pixels PXL have a rectangular shape as shown in FIGS. 6 and 7, the present disclosure is not limited. That is, in various embodiments, the pixels PXL may have various shapes such as a square, a rhombus, a hexagon, and an octagon. In addition, although the pixels PXL have the same area in FIGS. 6 and 7, the present disclosure is not limited. That is, in various embodiments, pixels PXL emitting light of arbitrary color (for example, light of red R and/or light of blue B) among the pixels PXL may have the area larger than that of other pixels PXL. Furthermore, each pixel may have different shape and different size compared to other adjacent pixels.

As shown in FIGS. 5, 6, and 7, the unit pixel areas PXA in the first display area AA1, that is, the pixels PXL, are disposed at a first density. For example, the first density may be a density at which the entire area of the first display area AA1 is substantially the same as the area where the pixels PXL are disposed because the pixels PXL are densely disposed in the first display area AA1. For example, the first density may be about 100%.

Figure 8:
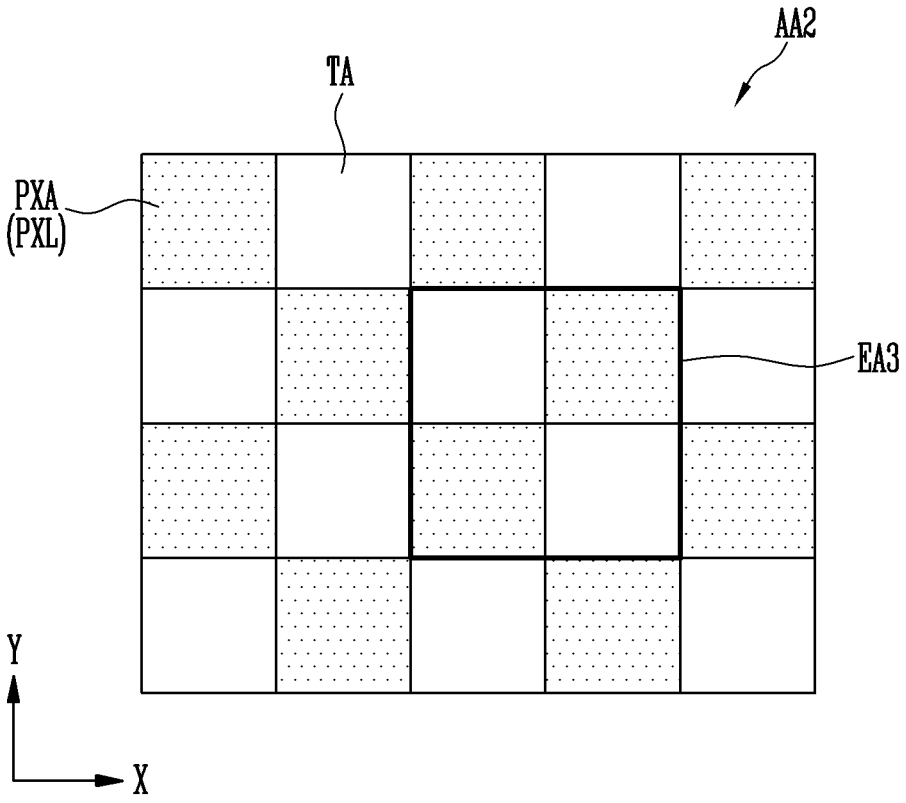
FIG. 8 is a top plan view schematically illustrating a second display area according to an embodiment.
Figure 9:
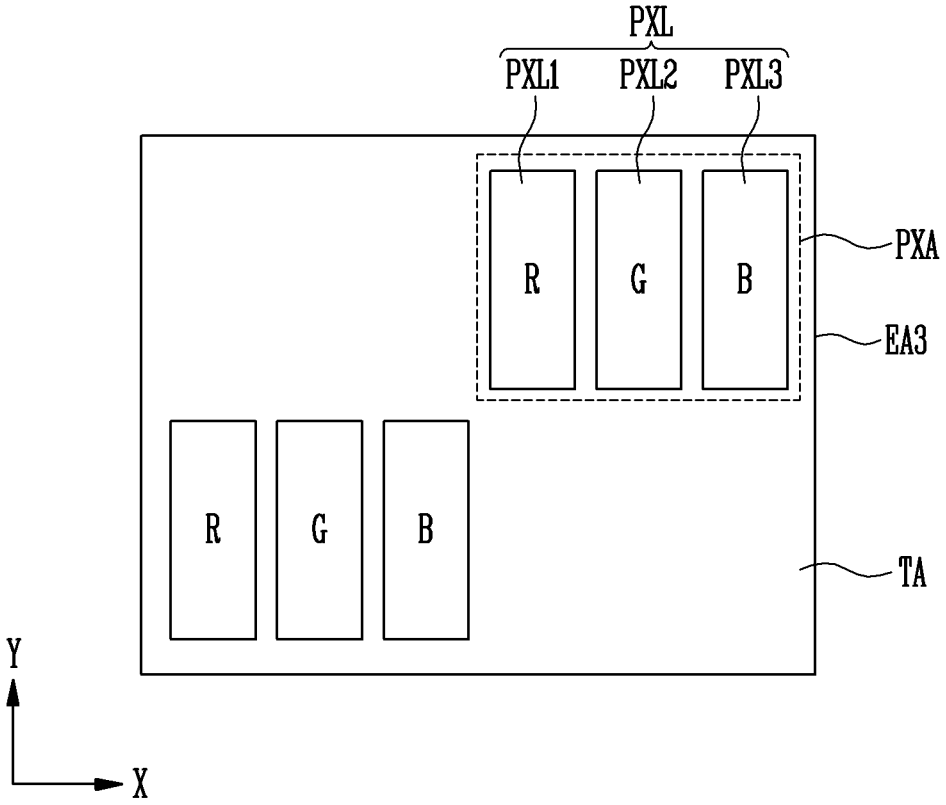
FIG. 9 is an enlarged view illustrating an EA3 region of FIG. 8 according to an embodiment.
Figure 10:
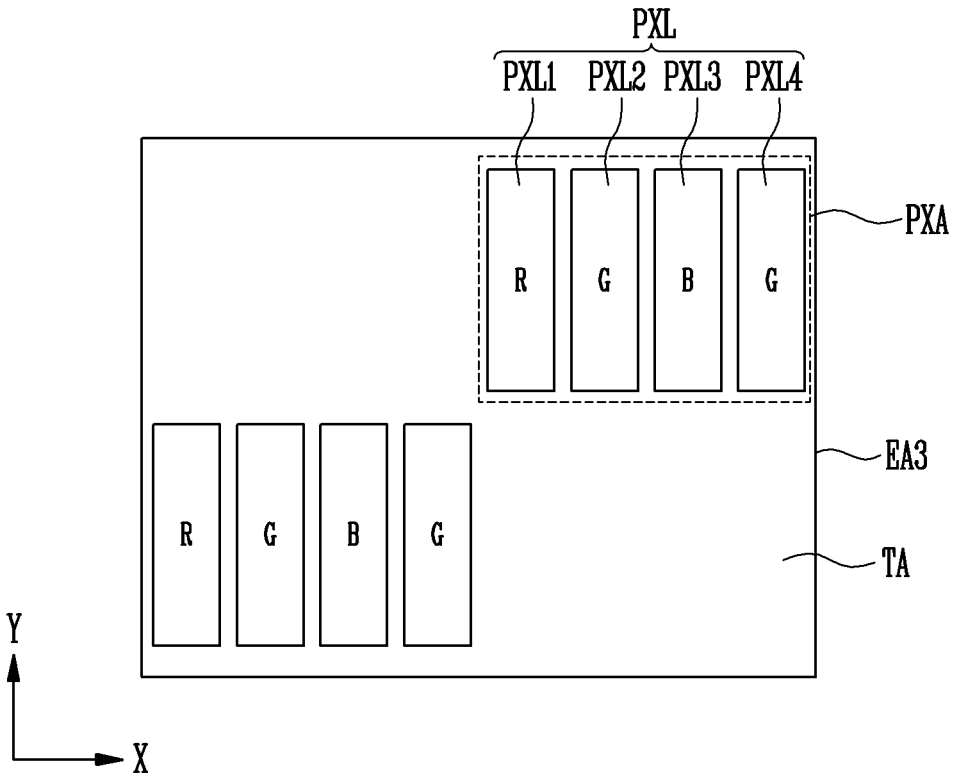
FIG. 10 is an enlarged view illustrating the EA3 region of FIG. 8 according to another embodiment.
Figure 11:
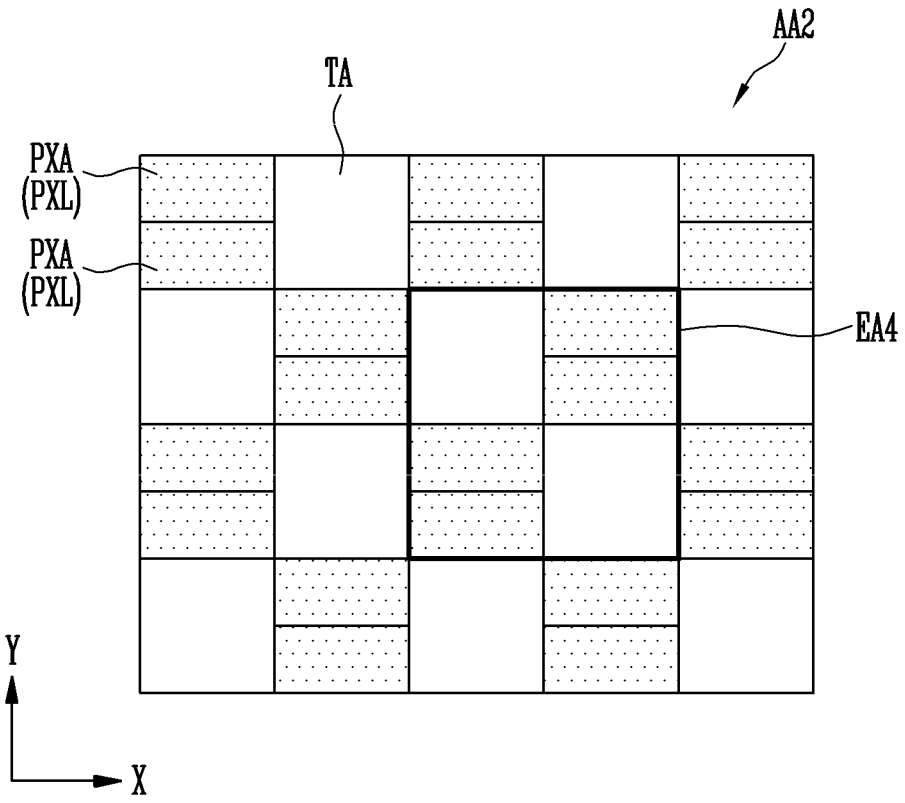
FIG. 11 is a top plan view schematically illustrating the second display area according to another embodiment.
Figure 12:
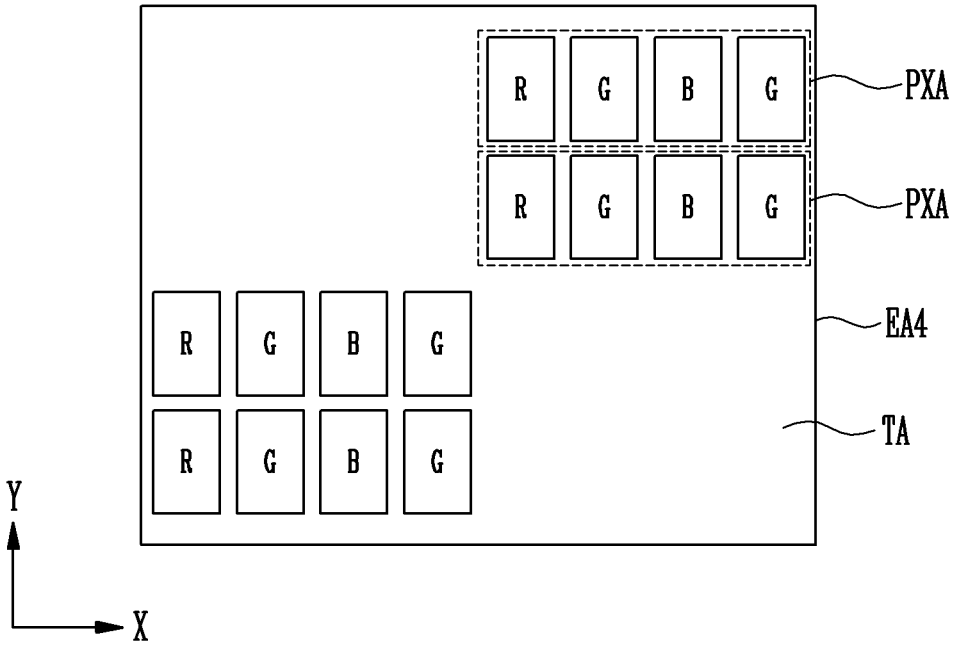
FIG. 12 is an enlarged view illustrating an EA4 region of FIG. 11 according to an embodiment.

FIG. 8 is a top plan view schematically illustrating a second display area according to an embodiment. FIG. 9 is an enlarged view illustrating an EA3 region of FIG. 8 according to an embodiment. FIG. 10 is an enlarged view illustrating the EA3 region of FIG. 8 according to another embodiment. FIG. 11 is a top plan view schematically illustrating the second display area according to another embodiment. FIG. 12 is an enlarged view illustrating an EA4 region of FIG. 11 according to an embodiment.

Referring to FIGS. 8 and 11, the second display area AA2 may include a unit pixel area PXA and a transmission area TA arranged in a matrix form. The unit pixel area PXA and the transmission area TA are alternately disposed along the first direction X. In addition, the unit pixel area PXA and the transmission area TA are alternately disposed along the second direction Y. The first direction X and the second direction Y may be substantially perpendicular.

In an embodiment, as shown in FIGS. 8, 9, and 10, one unit pixel area PXA and one transmission area TA may be alternately disposed along the first direction X and the second direction Y. In another embodiment, as shown in FIGS. 11 and 12, a plurality of unit pixel areas PXA and one transmission area TA may be alternately disposed in one of the first direction X and the second direction Y, or one unit pixel region PXA and a plurality of transmission areas TA may be alternately disposed in one of the first direction X and the second direction Y. In FIGS. 11 and 12, one unit pixel area PXA and one transmission area TA are alternately disposed in the first direction X, and two unit pixel areas and one transmission area TA are alternately disposed in the second direction Y.

The unit pixel area PXA may include pixels PXL (or sub pixels) that emit light of the same or different colors as shown in FIGS. 9, 10, 11, and 12. For example, the pixels PXL may emit light of red R, green G, and blue B. However, the present disclosure is not limited. That is, the pixels PXL included in the unit pixel area PXA may emit light of various colors when the pixels PXL may realize white light by any combination of the above colors.

As depicted in FIG. 9, in an embodiment, the unit pixel area PXA may include first, second, and third pixels PXL1, PXL2, and PXL3 arranged in the first direction X. The first, second, and third pixels PXL1, PXL2, and PXL3 may be arranged in a stripe pattern. For example, the first pixel PXL1 may emit light of red R, the second pixel PXL2 may emit light of green G, and the third pixel PXL3 may emit light of blue B.

As depicted in FIG. 10, in an embodiment, the unit pixel area PXA may include first, second, third, and fourth pixels PXL1, PXL2, PXL3, and PXL4 arranged in the first direction X. The first, second, third, and fourth pixels PXL1, PXL2, PXL3, and PXL4 may be arranged in a pentile pattern. For example, the first pixel PXL1 may emit light of red R, the second pixel PXL2 may emit light of green G, the third pixel PXL3 may emit light of blue B, and the fourth pixel PXL4 may emit light of green G. Or, the fourth pixel PXL4 may emit light of white.

Meanwhile, although the pixels PXL have a rectangular shape in FIGS. 9 and 10, the present disclosure is not limited. That is, in various embodiments, the pixels PXL may have various shapes such as a square, a rhombus, a hexagon, and an octagon. In addition, although the pixels PXL have the same area in FIGS. 9 and 10, the present disclosure is not limited. That is, in various embodiments, pixels PXL emitting light of arbitrary color (for example, light of red R and/or light of blue B) among the pixels PXL may have the area larger than that of other pixels PXL.

The transmission area TA may be a transparent window in which the pixel PXL is not disposed. That is, the transmission area TA may be an area in which circuit elements and the light emitting element configuring the pixel PXL are removed. As the circuit elements and the light emitting element are removed, only a transparent insulating layer which is provided between the circuit elements and/or between the circuit element and the light emitting element may be disposed in the transmission area TA.

In an embodiment, when some of the electrodes configuring the circuit elements and the light emitting element are formed of a transparent electrode, and the other of the electrodes configuring the circuit elements and the light emitting element are formed of an opaque electrode, the transmission area TA may be an area in which only the opaque electrode is removed. For example, the transmission area TA may be an area in which an opaque electrode (for example, the drain electrode described with reference to FIG. 2) and the light emitting layer of the organic light emitting diode configuring the pixel PXL are removed. Alternatively, the transmission area TA may be an area in which opaque electrodes configuring the circuit element are further removed.

As shown in FIGS. 8, 9, 10, 11, and 12, the unit pixel areas PXA in the second display area AA2, that is, the pixels PXL are disposed at a second density. The second density may be a ratio of the area excluding the area in which the transmission areas TA are disposed to the entire area of the second display area AA2.

The second density is smaller than the first density, which is the density of the pixels PXL disposed in the first display area AA1. In the embodiments of FIGS. 10, 11, and 12, the second density may be about 50%.

As the density of the pixel PXL in the second display area AA2 is smaller than in the first display area AA1, an image displayed in the second display area AA2 may be visually recognized relatively darker (that is, lower in luminance) than an image displayed in the first display area AA1. To resolve such a problem, the pixels PXL disposed in the second display area AA2 may be controlled to emit light with brighter luminance with respect to the same image data. For example, the pixels PXL disposed in the first display area AA1 are controlled to emit light at a first luminance, and the pixels PXL disposed in the second display area AA2 are controlled to emit light at a second luminance. Here, the second luminance may be greater than the first luminance.

In an embodiment, when the first density is about 100% and the second density is about 50%, the second luminance may be about twice the first luminance.

A rapid change of the density and the luminance of the pixel PXL between the first display area AA1 and the second display area AA2 may be visually recognized by a user as a discontinuity of the image. In order to alleviate the visibility of the image discontinuity, the pixels PXL may be controlled to gradually change a luminance in a portion of the first display area AA1 adjacent to the second display area AA2. Hereinafter, the technical features will be described in more detail.

Figure 13:
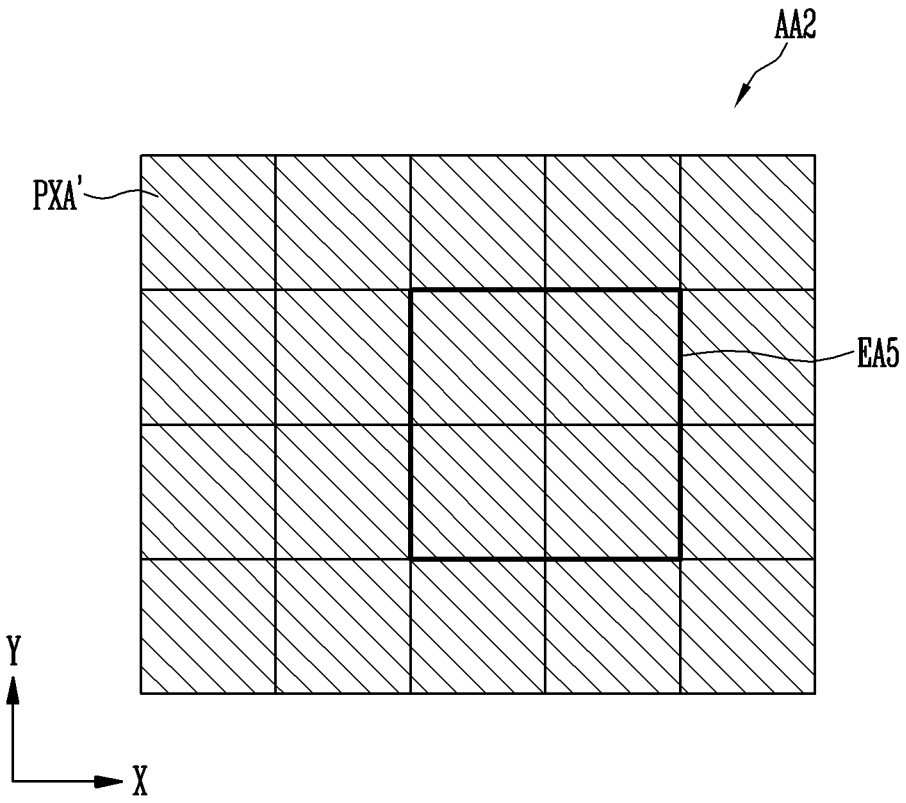
FIG. 13 is a plan view schematically illustrating the second display area according to another embodiment.
Figure 14:
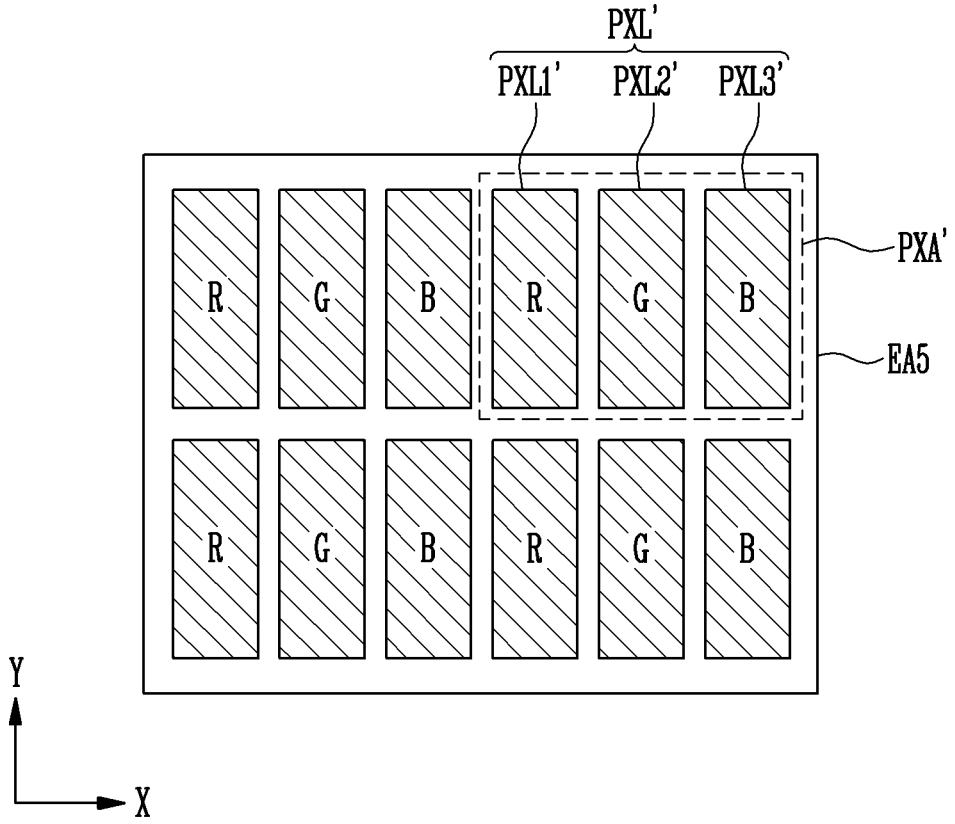
FIG. 14 is an enlarged view of an EA5 region of FIG. 13.

FIG. 13 is a top plan view schematically illustrating a second display area according to another embodiment. FIG. 14 is an enlarged view of an EA5 region of FIG. 13.

Referring to FIG. 13, the second display area AA2 may include an arrangement of unit pixel areas PXA', which is substantially the same as an arrangement of the unit pixel areas PXA of the first display area AA1 of FIG. 5. For example, a density of pixels per predetermined unit area of the second display area AA2 (or the total area of anodes included in the unit area) may be substantially the same as the density of pixels per unit area of the first display area AA1 (or the total area of anodes included in the unit area).

At this time, the second display area AA2 may not include the transmission area. As described above, at least one of the material and the layout of the pixels in the first display area AA1 may be different from at least one of the material and the layout of the pixels in the second display area AA2.

For example, referring to FIG. 14, anode electrodes of pixels PXL1', PXL2', and PXL3' of the unit pixel area PXA' in the second display area AA2 may be formed of a transmissive metal. At this time, anode electrodes of the pixels PXL1, PXL2, and PXL3 of the first display area AA1 may be formed of a reflective metal (refer to FIG. 6). Therefore, even though the second display area AA2 does include a transmission area in which the pixels PXL' are not disposed and the density (or the total area of the anode in the same area) of the pixels PXL' in the second display area AA2 is the same as the density (or the total area of the anode in the same area) of the pixels PXL in the first display area AA1, the transmittance of the second display area AA2 may be higher than the transmittance of the first display area AA1.

Figure 15:
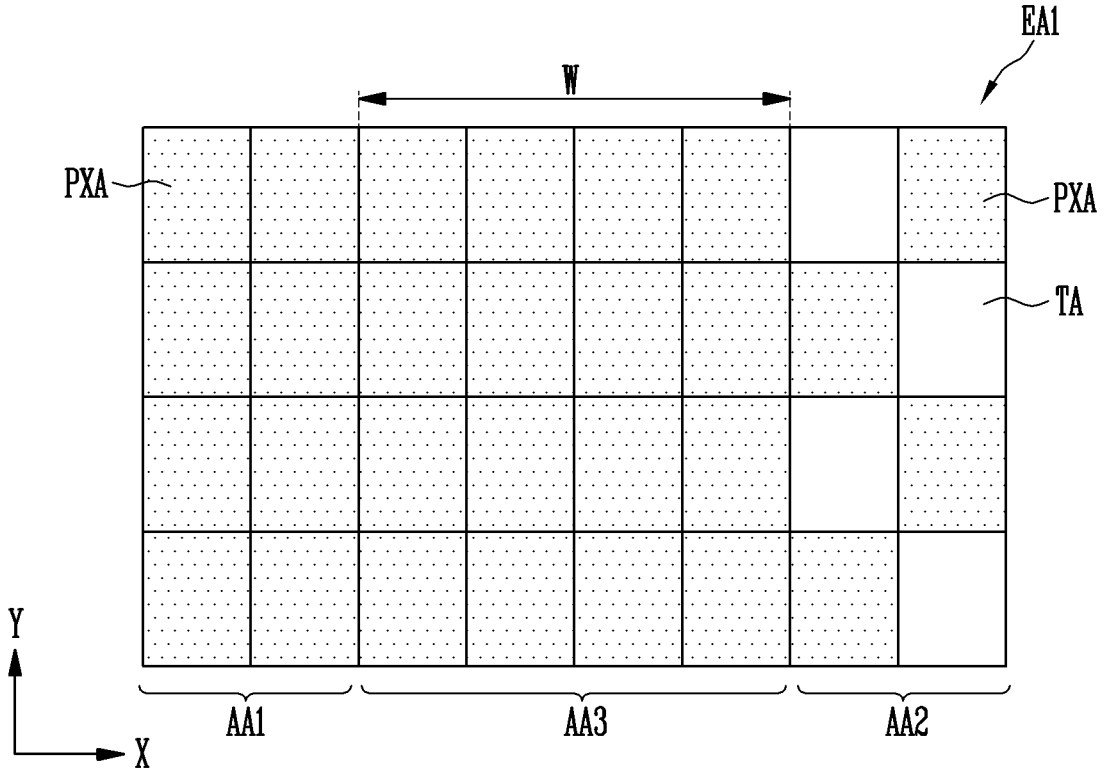
FIG. 15 is an enlarged view schematically illustrating an embodiment of an EA1 region of FIG. 3A.

FIG. 15 is an enlarged view schematically illustrating an embodiment of an EA1 region of FIG. 3A.

Although not shown in FIG. 3A, referring to FIG. 15, a third display area AA3 may be further provided between the first display area AA1 and the second display area AA2. The third display area AA3 may be an area surrounding the second display area AA2 and surrounded by the first display area AA1.

The third display area AA3 may have a shape corresponding to the second display area AA2. For example, the third display area AA3 may include the second display area AA2 inside, and may have a shape such as a circle, an ellipse, a rectangle, a polygon, or the like corresponding to the shape of the second display area AA2.

A width w of the third display area AA3, that is, a distance between a first end of the third display area AA3, which is abutted to the first display area AA1, and a second end of the third display area AA3, which is abutted to the second display area AA2, may be changed according to luminance control in the third display area AA3 which will be described later.

The unit pixel areas PXA in the third display area AA3, that is, the pixels PXL may be disposed at the same density as that of the first display area AA1. That is, when referring to the embodiments described above, the pixels PXL may be disposed in the third display area AA3 at the first density.

However, the present disclosure is not limited. In various embodiments, the unit pixel area PXA in the third display area AA3, that is, the pixels PXL, may be disposed at a density greater than that of the first display area AA1 and smaller than that of the second display area AA2.

Alternatively, in various embodiments, the pixels PXL may be disposed in the third display area AA3 such that a transmittance per unit area is gradually changed (or reduced) in a direction from the second display area AA2 to the first display area AA1. For example, the pixels PXL may be disposed in the third display area AA3 such that the density gradually changes from the second density to the first density in the direction from the second display area AA2 to the first display area AA1. Hereinafter, an example in which the pixels PXL are disposed in the third display area AA3 at the first density equal to that of the first display area AA1 will be described.

In order to improve visibility of an interface between the first display area AA1 and the second display area AA2, a luminance of the pixels PXL disposed in the third display area AA3 may be controlled. For example, when the pixels PXL of the first display area AA1 are controlled to emit light at the first luminance, and the pixels PXL of the second display area AA2 are controlled to emit light at the second luminance, the pixels PXL disposed in the third display area AA3 may be controlled to emit light at a luminance between the first luminance and the second luminance.

Hereinafter, a method of controlling luminance of the pixels PXL disposed in the third display area AA3 will be described in more detail.

Figure 16:
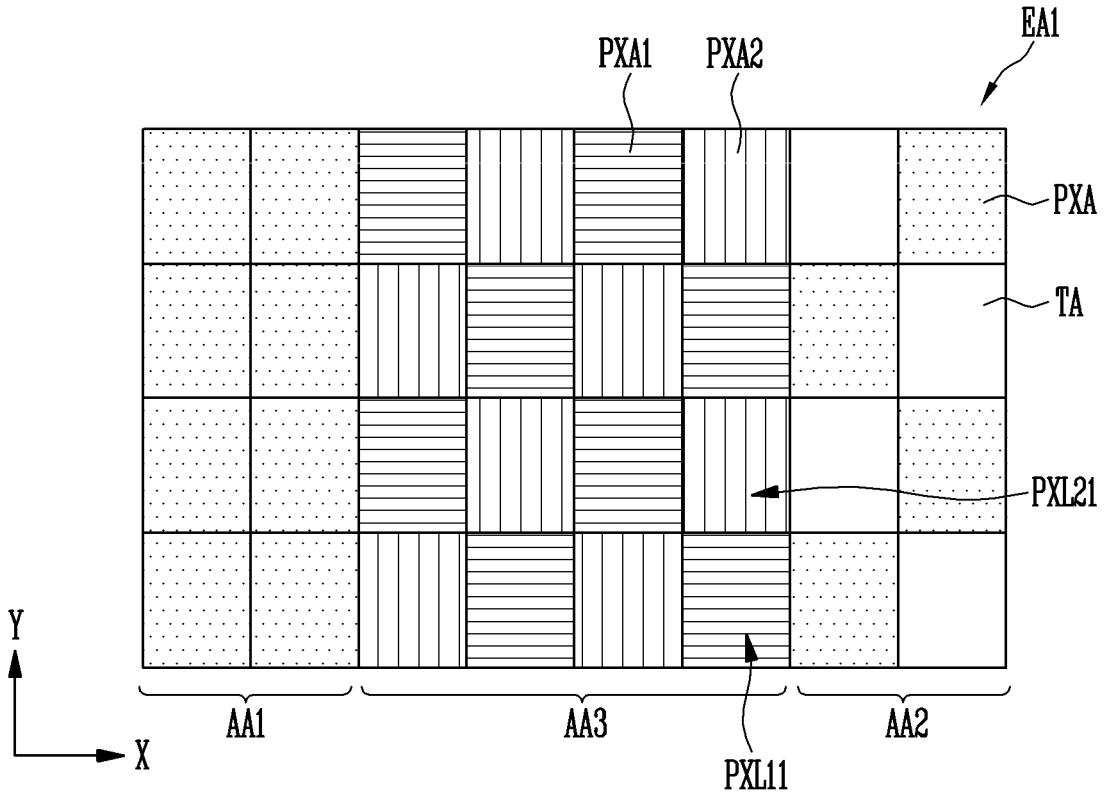
FIG. 16 is a diagram for describing a luminance control method for the EA1 region of FIG. 3A.

FIG. 16 is a diagram for describing a luminance control method for the EA1 region of FIG. 3A.

Referring to FIG. 16, the third display area AA3 includes first group unit pixel areas PXA1 and second group unit pixel areas PXA2. The first group unit pixel areas PXA1 and the second group unit pixel areas PXA2 are alternately disposed in the first direction X and the second direction Y respectively. Adjacent first group unit pixel areas PXA1 and second group unit pixel areas PXA2 may be paired.

In an embodiment, the first group unit pixel areas PXA1 and the second group unit pixel areas PXA2 may be controlled to gradually change a luminance according to a distance from the second display area AA2. At this time, pixels of any one of the first group unit pixel areas PXA1 and the second group unit pixel areas PXA2 are controlled to decrease the luminance according to the distance from the second display area AA2, and pixels of the other group of the first group unit pixel areas PXA1 and the second group unit pixel areas PXA2 are controlled to increase the luminance according to the distance from the second display area AA2. For example, the first group unit pixel areas PXA1 are controlled to gradually decrease the luminance as the distance from the second display area AA2 increases, and the second group unit pixel areas PXA2 are controlled to gradually increase the luminance as the distance from the second display area AA2 increases.

In an embodiment, the first group unit pixel areas PXA1 are controlled to decrease the luminance according to the distance from the second display area AA2 between the first luminance and the second luminance. In addition, the second group unit pixel areas PXA2 may be controlled to increase the luminance according to the distance from the second display area AA2 between the first luminance and the second luminance. A luminance increase rate between the adjacent first group unit pixel areas PXA1 and a luminance increase rate between the adjacent second group unit pixel areas PXA2 may be the same as or different from each other. In various embodiments, a luminance range in which the luminance of the third group of pixels PXL3 changes may include the first luminance and the second luminance, or may not include at least one of the first luminance and the second luminance.

A sum of the luminance of the pair of first group unit pixel areas PXA1 and second group unit pixel areas PXA2 adjacent in the second direction Y may be set to k times the first luminance of the first display area AA1. This is represented by Equation 1 below.

$$b+c=a\times k \quad \text{[Equation 1]}$$

Here, a is the first luminance, b is a luminance of first group unit pixel area PXA1, and c is a luminance of second group unit pixel area PXL2 adjacent to an first group pixel PXL1 in the second direction Y. Here, k is an integer, and may be selected as an appropriate value in order to alleviate a boundary visibility between the first display area AA1 and the second display area AA2 through the third display area AA3. For example, k may be determined in correspondence with a ratio of the second luminance and the first luminance. In an embodiment, when the second luminance is set to about twice the first luminance, k may be determined to two.

As depicted in FIG. 16, as the luminance is controlled as described above, pixels PXL11 disposed closest to the second display area AA2 among the first group unit pixel areas PXA1 may be controlled to a luminance higher than that of second group pixels PXL21 disposed closest to the second display area AA2 among the second group unit pixel areas PXA2. For example, in the above-described embodiment, the pixels PXL11 disposed closest to the second display area AA2 may be controlled to a luminance higher than that of the second group pixels PXL21 disposed closest to the second display area AA2.

In such an embodiment, the first group pixels PXL11 controlled to relatively high luminance may be disposed adjacent to the unit pixel area PXA of the second display area AA2, respectively, and the second group pixels PXL21 controlled to relatively low luminance may be disposed adjacent to the transmission areas TA of the second display area AA2, respectively. Therefore, a difference of the luminance between the second display area AA2 and the third display area AA3 may not be visually recognized by an user.

According to the present disclosure described above, the visibility of the discontinuity of the image may be improved between the second display area AA2 and the first display area AA1. Particularly, while the luminance gradually changes in the third display area AA3, the first group unit pixel areas PXA1 gradually changes from a high luminance to a low luminance, and the second group unit pixel areas PXA2 gradually changes from a low luminance to a high luminance in correspondence with an arrangement of the unit pixel area PXA and the transmission area TA disposed in the second display area AA2. Thus, the visibility of the boundary may be further improved.

Figure 17:
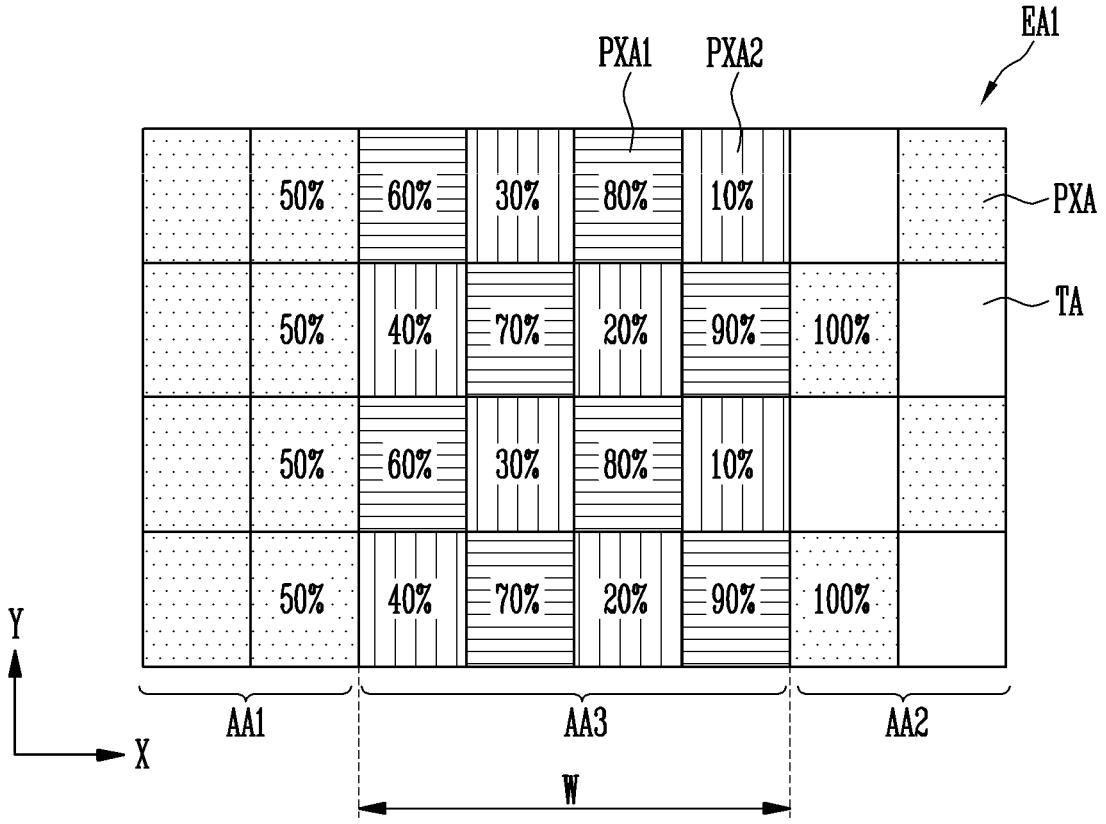
FIG. 17 is a diagram illustrating an embodiment in which a luminance is controlled with respect to the EA1 region of FIG. 3A.
Figure 18:
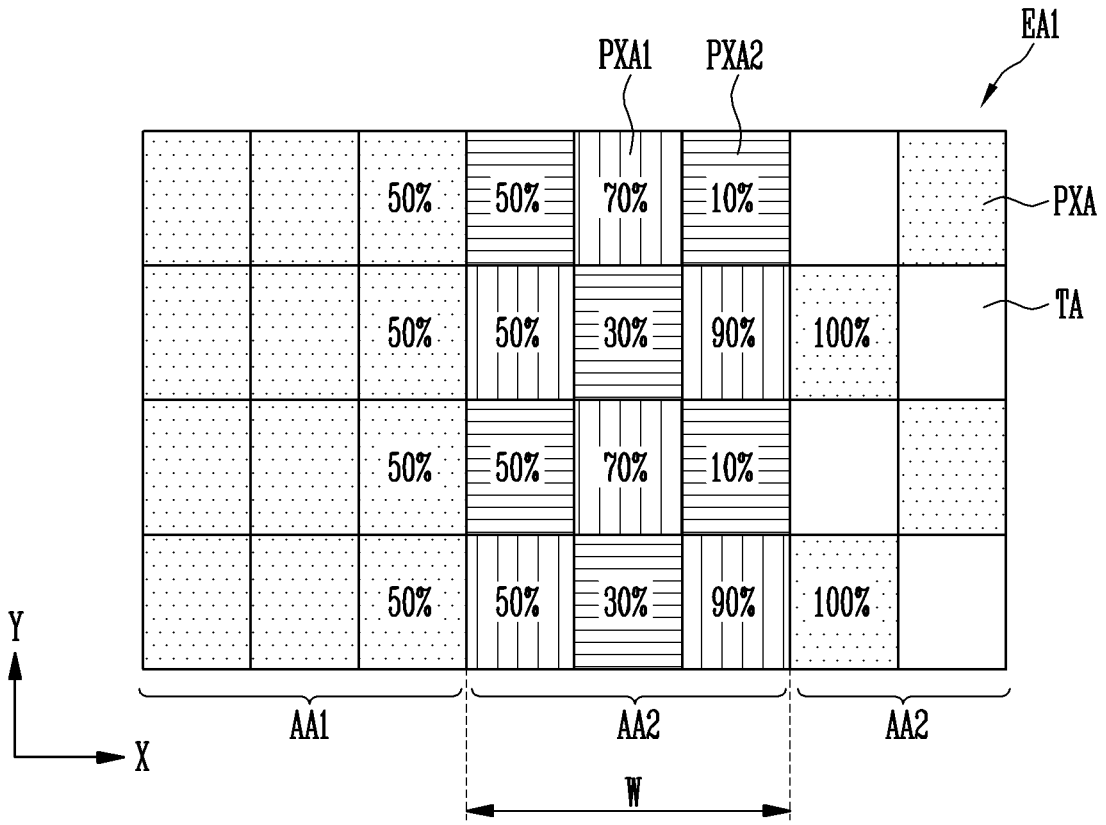
FIG. 18 is a diagram illustrating another embodiment in which the luminance is controlled with respect to the EA1 region of FIG. 3A.

FIG. 17 is a diagram illustrating an embodiment in which the luminance is controlled with respect to the EA1 region of FIG. 3A. FIG. 18 is a diagram illustrating another embodiment in which the luminance is controlled with respect to the EA1 region of FIG. 3A.

Referring to FIG. 17, the pixels PXL of the second display area AA2 may be controlled to about 100% luminance, and the pixels PXL of the first display area AA1 may be controlled to about 50% luminance. At this time, the pixels PXL of the third display area AA3 are controlled to a luminance greater than about 50% and less than about 100%. The pixels PXL of the third display area AA3 may be controlled to gradually change the luminance according to the distance from the second display area AA2 between the luminance between about 50% and about 100%.

The first group unit pixel areas PXA1 may gradually decrease by about 10% from about 90% luminance to about 60% luminance in accordance with the distance from the second display area AA2. The second group pixel areas PXA2 may gradually increase by about 10% from 10% luminance to 40% luminance by 10% in accordance with the distance from the second display area AA2.

Similarly, referring to FIG. 18, the pixels PXL of the second display area AA2 may be controlled to about 100% luminance, and the pixels PXL of the first display area AA1 may be controlled to about 50% luminance. At this time, the pixels PXL of the third display area AA3 are controlled to a luminance greater than about 50% and less than about 100%. The pixels PXL of the third display area AA3 may be controlled to gradually change the luminance according to the distance from the second display area AA2 between about 50% and about 100% luminance.

The first group unit pixel areas PXA1 may gradually decrease by about 20% from 90% luminance to 50% luminance in accordance with the distance from the second display area AA2. The second group unit pixel areas PXA2 may gradually increase by about 20% from 10% luminance to 50% luminance in accordance with distance from the second display area AA2.

In a case where the luminance is controlled according to the embodiment shown in FIG. 17 and a case the luminance is controlled according to the embodiment shown in FIG. 18, the width w of the third display area AA3 is differently set. That is, the width w of the third display area AA3 may be determined in correspondence with a difference between the first luminance and the second luminance, a luminance range between the pixels PXL in the third display area AA3, a luminance change amount, and the like.

Figure 19:
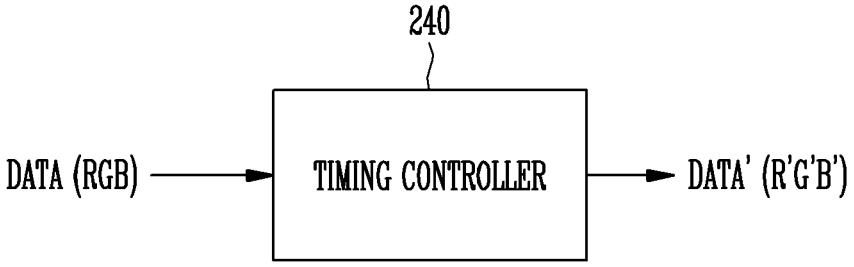
FIG. 19 is a diagram for describing an operation of a timing controller of FIG. 1.

FIG. 19 is a diagram for describing an operation of the timing controller of FIG. 1.

Referring to FIG. 19, the timing controller 240 receives image data DATA from an external source. The image data DATA may be RGB values for the image to be displayed in the display area AA. Specifically, the image data DATA may be RGB values for each of the unit pixel areas PXA included in the display area AA. In an embodiment, the image data DATA include RGB values for the second display area AA2 in which some of the unit pixel areas PXA are omitted. At this time, the image data DATA may also include RGB values corresponding to each of the transmission areas TA.

The timing controller 240 may correct the image data DATA based on an area in which the RGB values included in the image data DATA are to be displayed. For example, when an RGB value corresponds to the transmission area TA of the second display area AA2, the timing controller 240 may remove the corresponding RGB value or convert the corresponding RGB into a dummy value. Alternatively, for example, when an RGB value corresponds to the unit pixel area PXA of the second display area AA2, the timing controller 240 may correct the image data DATA such that the luminance is changed in a corresponding unit pixel area PXA. For example, the timing controller 240 may correct the image data DATA to increase the luminance in the corresponding unit pixel area PXA.

When the RGB value corresponds to the first display area AA1, the timing controller 240 may not correct the corresponding RGB value. When the RGB value corresponds to the third display area AA3, the timing controller 240 may control the luminance in a manner described above according to the distance from the second display area AA2 of the unit pixel area PXA in which the corresponding RGB value is to be displayed.

The timing controller 240 may output corrected image data DATA' to the data driver 220 as shown in FIG. 1.

It will be understood by those skilled in the art that the present disclosure may be carried out in other specific forms without changing the technical spirit or essential characteristics thereof. Therefore, it should be understood that the above-described embodiments are illustrative and not restrictive in all aspects. The scope of the present disclosure is defined by the following claims rather than the above detailed description, and it is intended that all changes and modifications drawn from the meaning and range of the claims and the equivalents thereof are included within the scope of the present disclosure.

What is claimed is:

1. A display device comprising:

a substrate;

a display panel comprising a first display area including a plurality of first pixels, a second display area including a plurality of second pixels, and a third display area disposed between the first display area and second display area and including a plurality of third pixels; and a component disposed between the substrate and the display panel and overlapping the second display area, wherein a transmittance of the second display area is higher than a transmittance of the first display area and transmittance of the third display area, wherein the plurality of third pixels are controlled such that a luminance gradually changes according to a distance from the second display area, wherein the first pixels and third pixels are disposed at a first density, and the second pixels are disposed at a second density smaller than the first density, wherein the plurality of first pixels are controlled to emit light at a first luminance, the plurality of second pixels are controlled to emit light at a second luminance, and the plurality of third pixels are controlled such that the luminance gradually changes from the first luminance to the second luminance or from the second luminance to the first luminance according to the distance from the second display area, wherein the second display area comprises:

second unit pixel areas each having at least one second pixel; and transmission areas alternatively disposed with the second unit pixel areas, in which the second pixel is not disposed, wherein the third display area comprises third unit pixel areas each having at least one third pixel, wherein the third unit pixel areas comprise first group unit pixel areas and second group unit pixel areas that are alternately disposed and independently controlled in a luminance, wherein the first group unit pixel areas are controlled to gradually decrease the luminance as the distance from the second display area increases, and wherein the second group unit pixel areas are controlled to gradually increase the luminance as the distance from the second display area increases.

2. The display device of claim 1, wherein the transmittance of the first display area is the same as the transmittance of the third display area.

3. The display device of claim 1, wherein the first group unit pixel areas closest to the second display area are disposed to be in contact with at least one of the second unit pixel areas.

4. The display device of claim 3, wherein a sum of the luminance of a pair of first group unit pixel area and second group unit pixel area adjacent to each other is controlled to be an integer multiple of the first luminance.

5. The display device of claim 4, wherein the integer is determined based on a ratio of the second luminance and the first luminance.

6. The display device of claim 1, wherein a width of the third display area is variable based on a luminance range of the third unit pixel areas and a luminance change rate of the third unit pixel areas.

7. A method of driving a display device comprising a substrate, a display panel including a first display area including a plurality of first pixels, a second display area including a plurality of second pixels, and a third display area disposed between the first and second display areas and including a plurality of third pixels, and a component disposed between the substrate and the display panel and overlapping the second display area, the method comprising:

receiving image data;

correcting a luminance of the image data according to a display area corresponding to the image data; and displaying an image based on the corrected image data, wherein correcting the luminance comprises correcting the luminance of the image data according to a distance from the second display area when image data corresponds to the third display area, wherein the plurality of third pixels are controlled such that a luminance gradually changes according to a distance from the second display area, wherein the first pixels and third pixels are disposed at a first density, and the second pixels are disposed at a second density smaller than the first density, wherein correcting the luminance comprises:

correcting the image data to a first luminance when the image data corresponds to the first display area;

correcting the image data to a second luminance when the image data corresponds to the second display area; and correcting the image data to a luminance between the first luminance and the second luminance according to the distance from the second display area when the image data corresponds to the third display area, wherein the second display area comprises:

second unit pixel areas each having at least one second pixel; and transmission areas alternately disposed with the second unit pixel areas, in which the second pixel is not disposed, wherein the third display area comprises third unit pixel areas each having at least one third pixel, wherein the third unit pixel areas comprise first group unit pixel areas and second group unit pixel areas that are alternately disposed and independently controlled in a luminance, wherein the first group unit pixel areas are controlled to gradually decrease the luminance as the distance from the second display area increases, and wherein the second group unit pixel areas are controlled to gradually increase the luminance as the distance from the second display area increases.

8. The method of claim 7, wherein a sum of the luminance of a pair of the first group unit pixel area and the second group unit pixel area adjacent to each other is controlled to be an integer multiple of the first luminance.

9. The method of claim 8, wherein the integer is determined based on a ratio of the second luminance and the first luminance.

* * * * *